US008136317B1

(12) United States Patent
McCown

(10) Patent No.: US 8,136,317 B1
(45) Date of Patent: Mar. 20, 2012

(54) ASSEMBLY FOR STRAIGHTENING A BASEMENT'S WALL

(76) Inventor: Matthew S. McCown, Wichita, KS (US)

( * ) Notice: Subject to any disclaimer, the term of this patent is extended or adjusted under 35 U.S.C. 154(b) by 167 days.

(21) Appl. No.: 12/646,420

(22) Filed: Dec. 23, 2009

(51) Int. Cl.

| | |
|---|---|
| ***E04G 23/00*** | (2006.01) |
| ***E02D 27/00*** | (2006.01) |
| ***E02D 37/00*** | (2006.01) |
| ***E04B 1/98*** | (2006.01) |
| ***E04H 9/02*** | (2006.01) |

(52) U.S. Cl. ..... 52/291; 52/293.1; 52/293.3; 52/573.1; 52/167.1; 52/167.3; 52/167.4; 52/514

(58) Field of Classification Search ..... 52/291, 52/127.1, 127.2, 127.5, 293.1, 293.2, 293.3, 52/573.1, 167.1, 167.3, 167.4, 514, 698
See application file for complete search history.

(56) References Cited

U.S. PATENT DOCUMENTS

| | | | | |
|---|---|---|---|---|
| 2,850,254 | A | 9/1958 | Houseworth | |
| 3,030,061 | A * | 4/1962 | Jennings | 248/354.3 |
| 3,817,006 | A * | 6/1974 | Williams | 52/127.2 |
| 4,068,427 | A * | 1/1978 | Camardo | 52/127.2 |
| 4,189,891 | A | 2/1980 | Johnson et al. | |
| 4,893,784 | A | 1/1990 | Abraham et al. | |
| 4,970,835 | A | 11/1990 | Harmon | |
| 5,829,220 | A | 11/1998 | Zumeta | |
| 5,845,450 | A | 12/1998 | Larsen | |
| 5,992,126 | A | 11/1999 | Ashton et al. | |
| 6,023,901 | A | 2/2000 | Jensen | |
| 6,269,606 | B1 | 8/2001 | McCown | |
| 6,357,190 | B1 | 3/2002 | Florentine | |
| 6,662,505 | B2 | 12/2003 | Heady et al. | |
| 6,769,222 | B2 | 8/2004 | Billante | |
| 6,931,805 | B2 | 8/2005 | Gregory et al. | |
| 7,380,372 | B2 | 6/2008 | Resch et al. | |
| 7,419,335 | B1 | 9/2008 | Cohen | |
| 7,681,367 | B2 * | 3/2010 | Morton et al. | 52/291 |
| 7,726,093 | B2 * | 6/2010 | Morton et al. | 52/745.09 |
| 7,861,469 | B2 * | 1/2011 | Heady et al. | 52/127.2 |
| 2003/0131555 | A1 | 7/2003 | Heady et al. | |
| 2005/0204673 | A1 * | 9/2005 | Reed | 52/514 |

FOREIGN PATENT DOCUMENTS

| | | |
|---|---|---|
| DE | 3140287 | 4/1983 |

* cited by examiner

*Primary Examiner* — Mark Wendell
(74) *Attorney, Agent, or Firm* — Kenneth H. Jack; Davis & Jack, L.L.C.

(57) ABSTRACT

An assembly for straightening a basement's wall, the basement having a floor and being covered by joists which are spaced from each other on center distances to define interstitial cavities and are arranged a perpendicular array or a parallel array, the assembly having mounting plate; joist mounting fasteners attaching the oblongated mounting plate to joists, the fasteners, upon the perpendicular joist array, positioning the mounting plate within an interstitial cavity, and the fasteners, upon the parallel array, bridging the mounting plate across an interstitial cavity; a rigid beam having upper and lower ends; a jack screw for driving the rigid beam's upper end toward the basement's wall; and an anchor bracket for resisting movement of the rigid beam's lower end away from the basement's wall.

16 Claims, 3 Drawing Sheets

ASSEMBLY FOR STRAIGHTENING A BASEMENT'S WALL

FIELD OF THE INVENTION

This invention relates to mechanisms and apparatus which are adapted for straightening or righting inwardly bulging or inwardly displaced basement walls. More particularly, this invention relates to such assemblies which are anchored or grounded at points within the interior of a building's basement, and which include a driven component which impinges and presses outwardly against an interior surface of such bulging or displaced basement wall.

BACKGROUND OF THE INVENTION

Assemblies for straightening a basement's inwardly bulging or displaced wall which include or incorporate a vertically oriented rigid beam and which include apparatus anchored within the basement for outwardly driving such beam against an inner surface of such wall are known. However, such known basement wall straightening assemblies typically include or incorporate an upper beam driving mechanism which cannot be efficiently, conveniently, compactly or unobtrusively mounted at or upon the various floor joist configurations which commonly overlie and are supported by the basement's wall.

Also, such known basement wall straightening assemblies commonly incorporate lower beam anchors which excessively and undesirably obtrude into and along the basement's floor space. The instant inventive assembly for straightening a basement's wall solves or ameliorates such problems or deficiencies of such commonly known basement wall straightening assemblies by providing specially adapted anchoring and jacking structures which facilitate secure mounting of upper beam jacking mechanism at alternative and convenient locations upon floor joist arrays, either within a floor joist cavity or interstitial space, or in an underlying configuration which perpendicularly bridges beneath such spaces and joists. The instant inventive assembly provides such versatility in mounting its upper beam jacking mechanism while additionally providing a substantially protrusion free low end anchor assembly which is adapted to outwardly pull the rigid beam's lower end toward the inwardly deflected wall simultaneously with outward driving of the beam's upper end.

BRIEF SUMMARY OF THE INVENTION

The instant assembly is for use for straightening a basement's inwardly bulging or displaced wall. A first structural component of the instant inventive assembly comprises an oblongated mounting plate having a length which is at least as great as the lateral spacing distance or "on center" distance of the array of floor joists which commonly cover a basement and form the basement's ceiling.

Such on center distance is typically substantially equal to 16" and, accordingly, the length of the instant invention's oblongated mounting plate is preferably at least as great as 16". However, in a preferred embodiment of the instant invention, the length of the oblongated mounting plate is slightly greater than 48" in order to allow the oblongated mounting plate to extend perpendicularly across and be fixedly attached to four adjacent floor joists, such mounting configuration causing the plate to bridge beneath the three successive interstitial cavities defined by such joists. Suitably, though less desirably, the oblongated mounting plate may be sized to have a length slightly greater than 34" for perpendicularly spanning beneath and attaching to three of such joists.

The oblongated mounting plate component preferably has a series of fastener receiving apertures extending therethrough, such apertures being spaced along the plate at intervals substantially equal to the joists' on center spacing. Where the oblongated mounting plate is configured, as preferred, four apertures spaced 16" apart along the length of the plate are provided. Also in the preferred embodiment of the instant inventive assembly, the oblongated mounting plate is composed of durable steel, has a 1½" to 2½" lateral width, and has a plate thickness of ¼" to ½".

The instant inventive assembly for straightening a basement's wall preferably further comprises joist mounting means which includes or incorporates the oblongated mounting plate's fastener receiving apertures as described above. The joist mounting means preferably further comprises a series of fasteners selected from the groups of bolts, wood screws, nails, and rivets. Where the floor joists overlying a basement's interior are configured in an array extending perpendicularly from an inwardly bulging basement wall, the joist mounting means are preferably adapted and are utilized for compactly and unobtrusively upwardly recessing the oblongated mounting plate within one of the interstitial spaces or cavities existing between an adjacent pair of the floor joists. In order to accommodate for an alternative floor joist configuration wherein the joists are arrayed in a parallel and overlying orientation with respect to the inwardly bulging wall, the joist mounting means is preferably further adapted so that the oblongated mounting plate may be alternatively mounted perpendicularly across lower surfaces of the floor joists to bridge beneath their defined interstitial spaces or cavities.

In the preferred embodiment, where a parallel floor joist array is present, the joist mounting means preferably comprises helically threaded wood screws. Alternatively, upon presentation of a perpendicular floor joist array, the floor joist attaching means preferably comprises nut, bolt, and washer combinations which extend through and compressively sandwich a single floor joist between nuts and washers and the oblongated mounting plate.

A further structural component of the instant inventive assembly comprises a rigid beam. The rigid beam preferably comprises a length of 4"×6" pinewood timber which may be acquired by residential homeowners at a local lumber yard. Suitably, the rigid beam may alternatively comprise a steel "I" beam or a length of steel square tubing. Where the floor joist array overlying the basement wall to be straightened extends perpendicularly from the basement wall, such beam preferably has a vertical length sufficient to extend upwardly from the basement's floor into a recessed position within one of the interstitial spaces or cavities formed by the floor joists. Alternatively, in the parallel joist array configuration, the beam is preferably sized to fit beneath the floor joist's lower surfaces.

A further structural component of the instant inventive assembly comprises a jack screw mechanism or assembly which is preferably connected operatively to the oblongated mounting plate. Preferably, the jack screw assembly is adapted for outwardly driving the rigid beam's upper end toward and against the basement's bulging wall. In a preferred embodiment, the jack screw assembly comprises a helically threaded sleeve and screw shaft combination wherein such shaft's outer end presents a rotatably mounted beam engaging bracket, and wherein such shaft's inner end presents turning means such as a wrench engaging hex head.

A further structural component of the instant inventive assembly comprises anchor means which are preferably connected operatively to the rigid beam's lower end, the anchor means being adapted for, upon outward driving of the rigid beam's upper end toward the basement's bulging wall, resisting any rocking counter movement of the rigid beam's lower end away from such wall. In a preferred embodiment, the anchor means comprises left and right helically threaded posts or lugs which are embedded within the basement wall at such wall's lower end. Such anchor means preferably further comprises a laterally flanged "U" bracket which is fitted for capturing the rigid beam's lower end and whose lateral flanges include eyes fitted for receiving the wall anchored posts. Helically threaded nuts mounted over the left and right helically threaded posts secure the "U" bracket and the beam's lower end which is captured by the "U" bracket. In the preferred embodiment, such nuts may be simultaneously turned for outwardly drawing the rigid beam's lower end simultaneously with the outward driving of such beam's upper end, such simultaneous beam end drawing and driving advantageously allowing the rigid beam to remain substantially parallel to the wall as the wall is straightened. In such preferred embodiment, the anchor means, including its post, bracket, and nut components, are configured and arranged so that no component attaches to the basement's floor and so that protrusions extending from the beam and into the basement's floor space are limited to the plate thickness of the "U" bracket. Such plate thickness is preferably less than or equal to ½", allowing sheetrock mounted to the beam's inner surface to be finished to a clear surface over the bracket.

In an exemplary operation of the preferred embodiment of the instant inventive assembly, it may be assumed that a basement of a residential building has at least two inwardly bulging walls in need of straightening, one of such walls extending parallel to the floor joist array overlying the basement space, and one of such walls extending perpendicular to such joist array. In such exemplary scenario, it may be also be assumed that six vertically oriented rigid beams are to be spaced along and driven outwardly against such basement walls, three against the parallel basement wall and three against the perpendicular basement wall.

For each of the six rigid beams, a low end anchor means configured as described above is provided. Also, six substantially identically configured upper jack screw assemblies are provided for mounting upon the floor joists and for engaging and outwardly driving the upper ends of the six rigid beams.

The three rigid beams which are to be driven outwardly against the perpendicularly oriented basement wall are preferably sized to have vertical lengths sufficient to upwardly extend from the floor to unobtrusively recess within overlying interstitial spaces between adjacent pairs of the floor joists. Within such interstitial spaces, three of the jack screw assemblies are preferably attached by nut, bolt, and washer combinations to side walls of floor joists within such interstitial spaces. Accordingly, for the perpendicular basement wall, all three upper jack screw assemblies are compactly and unobtrusively recessed within an interstitial floor joist space or cavity. Along the perpendicular basement wall, basement finishing sheetrock may be applied at the ceiling and along the rigid beams with no obtrusions of any wall straightening mechanism into the finished room space.

While somewhat more obtrusively installed, the three identically configured jack screw assemblies which are installed along the parallel basement wall are equally capable of secure attachment to the floor joists in a perpendicular interstitial space bridging fashion. Thus, the upper beam jacking assembly of the instant invention advantageously functions for beam driving engagement regardless of the orientation of the basement wall with respect to the floor joist array.

Accordingly, objects of the instant invention include the provision of an assembly for straightening a basement wall which incorporates structures as described above, and which arrange those structures in relation to each other in manners described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
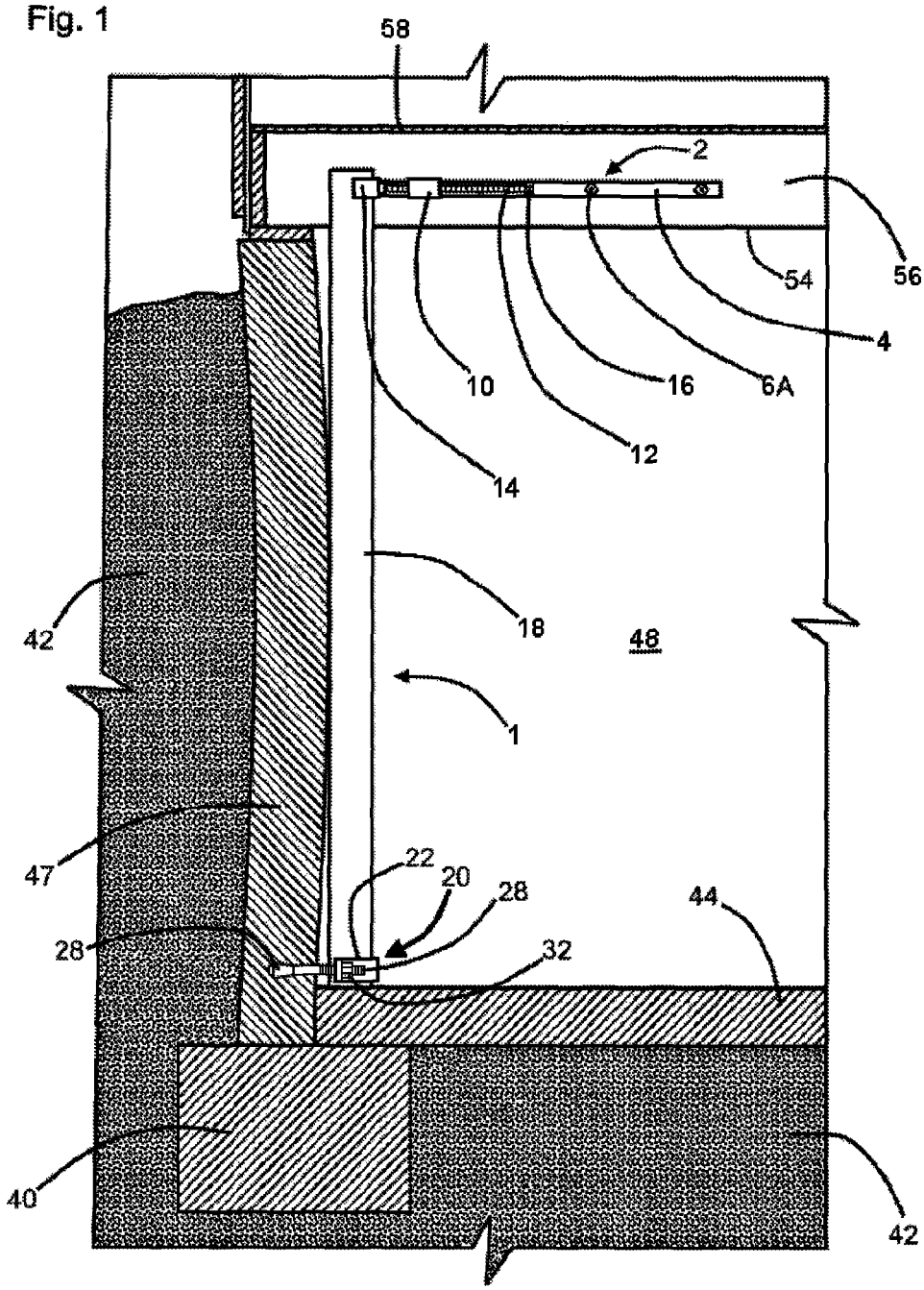
FIG. 1 presents a side view of the instant assembly for straightening a basement's wall, the view showing the basement's wall in sectional view, and extending perpendicularly with respect to a floor joist array.
Figure 1A:
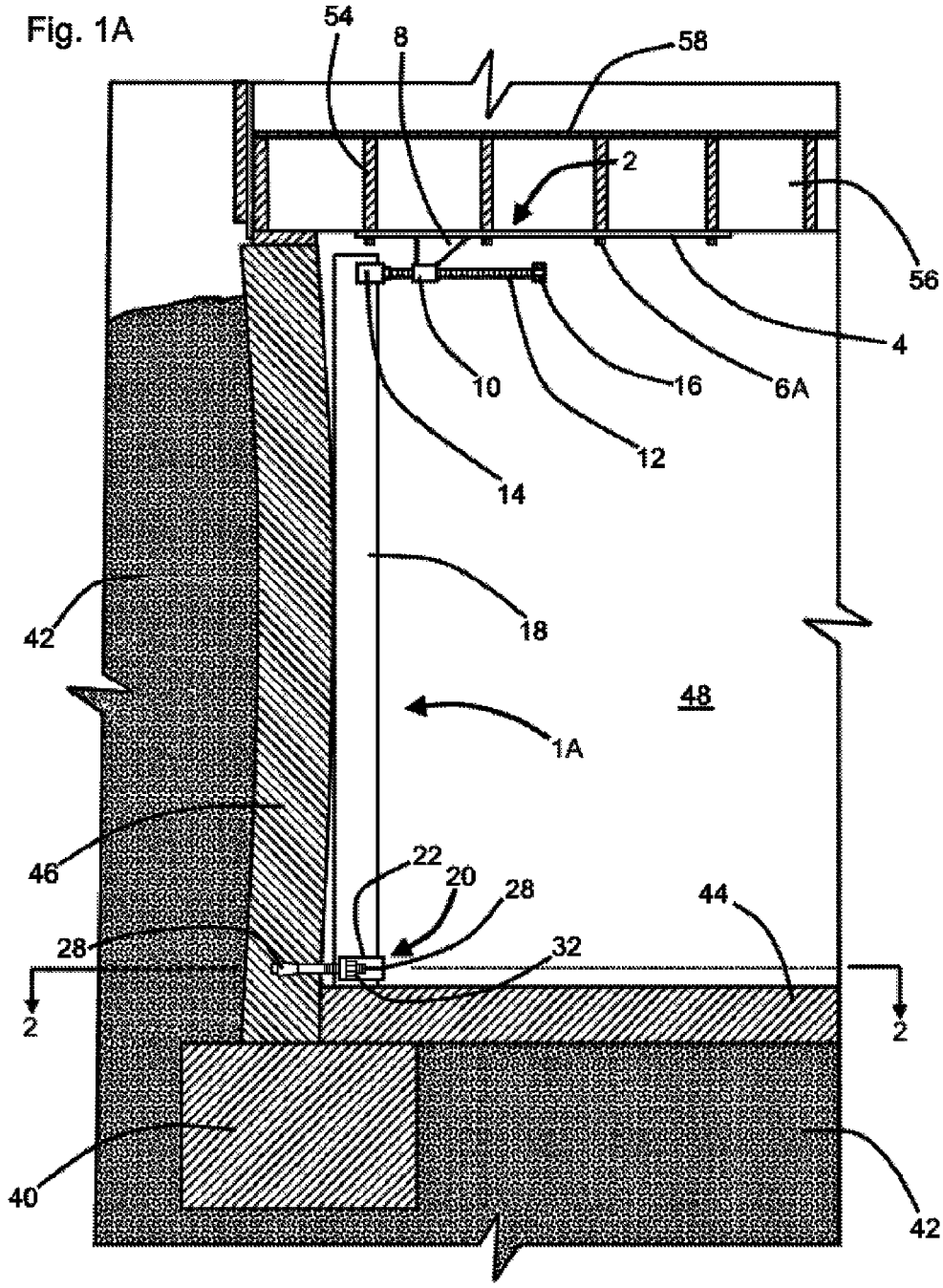
FIG. 1A redepicts FIG. 1, the view of FIG. 1 showing an alternative configuration of the instant inventive assembly wherein the basement wall extends parallel to the joists of the floor joist array.

Referring now to the drawings, and in particular to FIG. 1, a preferred embodiment of the instant inventive assembly for straightening a basement's wall is referred to generally by Reference Arrow 1. The assembly comprises an upper beam jacking assembly which is referred to generally by Reference Arrow 2. Such assembly 2 comprises an oblongated mounting plate 4 which, referring further simultaneously to FIG. 1A, is sized for fixed attachment across the undersurfaces of four floor joists 54. The array of floor joists 54 overlies and forms, along with flooring 58, a ceiling which covers the basement's interior space 48. Such floor joists 54 are typically spaced apart in substantially equivalent "on center" distances, such distances typically being substantially equal to 16". The on center spacing of such floor joists 54 typically creates between the joists a series of interstitial spaces or hollow floor cavities 56. The oblongated mounting plate 4 is preferably fitted and sized in relation to such on center joist spacing, the plate having a length that is at least as great as one of the on center spacing distances (e.g., greater than 16") so that, in the perpendicular mounting configuration of FIG. 1A, the oblongated mounting plate 4 may be fixedly attached to the undersurfaces of an adjacent pair of the floor joists 56 and may underlie and bridge across at the interstitial space 56 which is bounded and defined by those two joists. Notwithstanding, in the preferred embodiment, as depicted in FIGS. 1 and 1A, the oblongated mounting plate 4 is sized to extend horizontally a distance slightly greater than 48" so that the plate may be fixedly attached to four adjacent floor joists 54. Preferably, the oblongated mounting plate 4 comprises durable steel, has a width between 1½" and 2½", and has a plate thickness between ¼" and ½".

Referring further simultaneously to FIGS. 1 and 1A, the instant inventive assembly preferably further comprises joist mounting means which preferably comprise bolt, screw, nail, or rivet receiving apertures which extend through the oblongated mounting plate 4. Where the oblongated mounting plate 4 is to be mounted upon a joist side wall for use in the perpendicular joist array depicted in FIG. 1, the joist mounting means preferably comprises a series of nut, bolt, and washer combinations 6 which extend laterally or horizontally through a floor joist 54 from vertical face to vertical face. Cross bracing (not depicted) or block buttressing (not depicted) over the plate 4, when installed as depicted in FIG. 1A, may be applied as needed for avoidance of deflection of the joists' lower edges.

In the parallel joist array mounting configuration of FIG. 1A, the joist mounting means preferably comprises a series of lag screws 6A having wood biting helical threads. The screws 6A extend vertically through the oblongated mounting plate to bore upwardly into and securely engage the lower faces or edges of four successive floor joists 54. The joist mounting means utilized in the FIG. 1A configuration may suitably, though less desirably, alternatively comprise nails.

Referring further simultaneously to FIGS. 1 and 1A, a further structural component of the instant inventive assembly comprises a rigid vertically extending beam 18. For residential use, such beam preferably comprises a 4"×6" wooden post which may be commonly purchased at a lumber yard. Suitably, the rigid 18 beam may alternatively comprise a steel "I" beam or a length of steel square or rectangular tubing. Where, as depicted in FIG. 1, a residence's basement wall 47 extends perpendicularly across the ends of floor joists 54, the vertical dimension of the rigid beam 18 is preferably fitted to extend upwardly from the floor 44 into one of the overlying interstitial spaces 56 for engagement with the assembly's joist side wall mounted jack screw assembly 2. Alternatively, with reference to the parallel floor joist array configuration of FIG. 1A, the rigid beam 18 may be cut slightly shorter so that it's upper end immediately underlies the undersurfaces of the floor joists 54.

Referring further simultaneously to FIGS. 1 and 1A, the upper jack screw assembly 2 preferably further comprises a cantilevering arm 8 whose proximal end is preferably fixedly welded to the face of the oblongated mounting plate 4. An internally helically threaded sleeve 10 is preferably fixedly welded to the distal end of the arm 8, and an externally helically threaded steel shaft 12 is preferably threadedly received by and extends longitudinally through the sleeve 10. A beam capturing "C" bracket 14 is preferably rotatably mounted upon the outer driving end of the shaft 12 and turning means, preferably configured as a hexagonal wrench engaging head 16, is presented at such shaft's inner end.

Referring simultaneously to all figures, it may be seen that the beam 18 has a lateral width (e.g., approximately 4" upon utilization of a 4"×6" beam). The cantilevered extension of the arm 8 is preferably sized and fitted so that the central longitudinal axis of the helically threaded steel shaft 12 is displaced from the face of the oblongated mounting plate 4 a distance at least as great as the thickness of one of the arms of the "C" bracket 14 plus one-half of the lateral width of the rigid beam 18. For example, where the "C" bracket has a ¼" plate thickness and where the beam 18 has a 4" lateral width, the arm 8 is preferably sized to extend the longitudinal axis of the shaft 12 away from the plate 4 at least 2¼". Such fitted extension of the arm 8 advantageously avoids, in the FIG. 1 floor joist array configuration, any mechanical interference between the bracket 14 and the plate 6.

Figure 2:
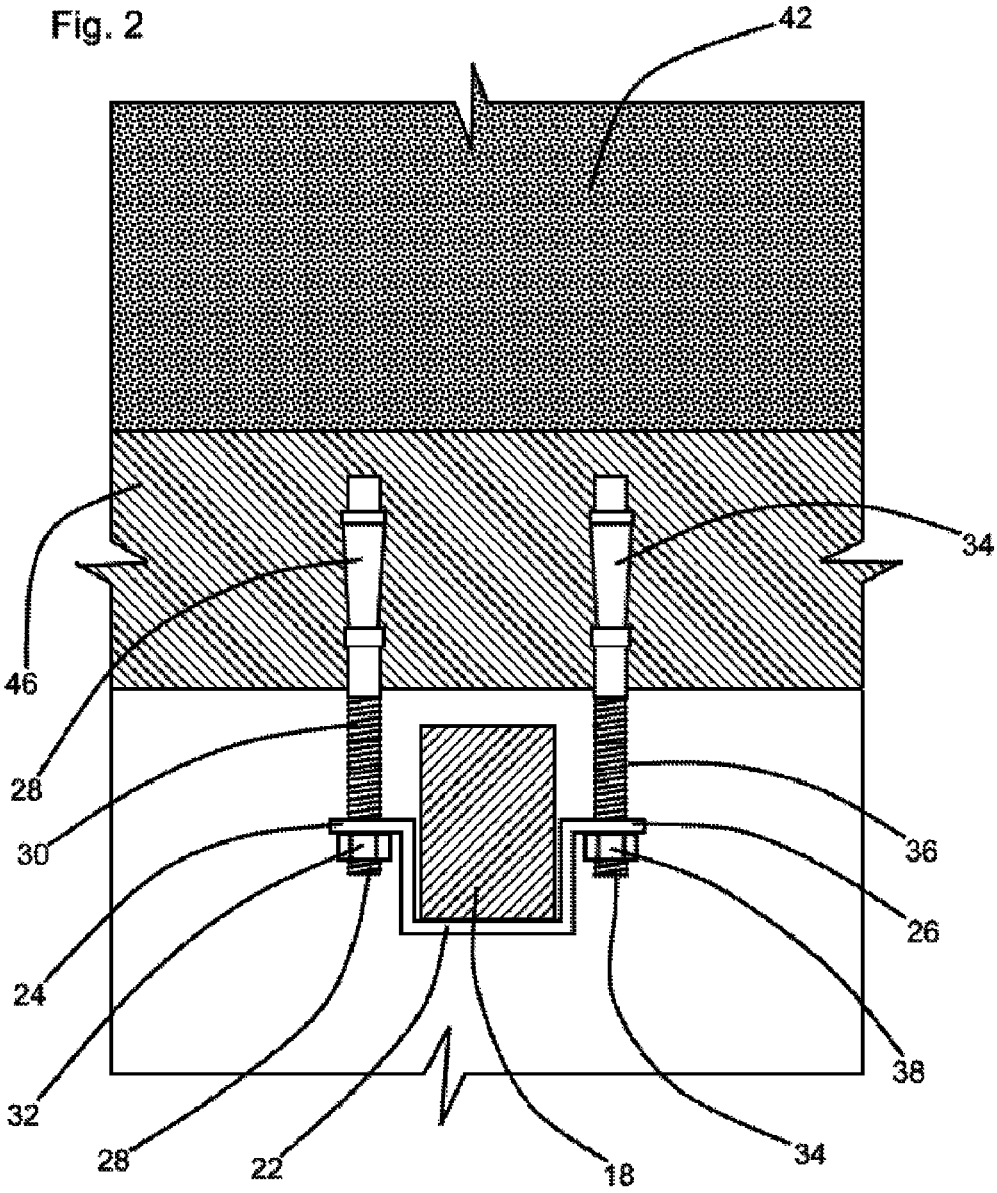
FIG. 2 is a sectional view as indicated in FIG. 1A.

Referring simultaneously to FIGS. 1A and 2, the instant inventive assembly preferably further comprises anchor means which are connected operatively to the lower end of the rigid beam 18, the anchor means being referred to generally by Reference Arrow 20. Upon operation of the upper jack screw assembly 2 to outwardly drive the upper end of the rigid beam 18 toward wall 46, the anchor means advantageously resists any rocking counter movement of the lower end of beam 18 away from the wall 46. In a preferred embodiment, the anchor means comprises left and right steel posts or lugs 28 and 34 which are securely anchored upon and embedded within the typically concrete material of the basement wall 46 (or as in FIG. 1, the basement wall 47). The inwardly extending ends of the posts or lugs 28 and 34 preferably present helical threads 30 and 36 for engagement with helically threaded nuts 32 and 38. A beam capturing "U" bracket 22 having laterally extending flanges 24 and 26 preferably receives the posts 28 and 34 through eyes or apertures which extend through the flanges 24 and 26.

Referring to FIG. 1, the basement 48 typically has a concrete slab floor 44 which partially rests upon earth 42 and which partially rests upon and is supported by a peripheral concrete footing 40. Referring further to FIG. 1A, the concrete footing 40 additionally provides support to the orthogonally oriented basement walls 46 and 47. Lateral loading forces applied by the earth 42 against the outer faces of the basement's walls 46 and 47 may undesirably cause such walls to inwardly deflect or bulge as depicted in FIGS. 1 and 1A.

In use of the inventive assembly for straightening a basement's wall, and assuming the presentation of inwardly bulging basement walls 47 and 46 as depicted in FIGS. 1 and 1A, a plurality of substantially identically configured upper jacking assemblies 2 may be attached to the basement's floor joists 54, and a plurality of substantially identical anchor assemblies 20 may be attached in vertically underlying orientations at the base or lower ends of the walls 47 and 46. The upper jacking assemblies 2 which extend in series along the perpendicularly oriented basement wall 47 may be conveniently and unobtrusively recessed within interstitial spaces 56 of the floor joist array. Alternatively, upper jacking assemblies 20 which extend in series along the parallel wall 46 are preferably attached in a perpendicular fashion by lag screws 6A to the undersurfaces of joists 54 to bridge across spaces 56.

During dry months of the year, horizontally directed pressure exerted by the ground 42 against the outer surfaces of the walls 46 and 47 typically decreases. At such times, wrenches may be applied to and turned against the hex head 16 and the nuts 32 and 26 to drive the beam 18 outwardly against the inner faces of the walls 46 and 47, counter-buckling and straightening such walls. Upon cessation of outer ground pressure, the walls' resistance to counter buckling is typically less than the resistance of the floor joists 54 to displacement, such resistance differential advantageously allowing the inventive assembly to straighten the walls without any structural damage to the building's floor joists. Simultaneous operation of the upper jacking assemblies 2 and the lower anchors 12 advantageously keeps the outer face of the beam 18 in a parallel orientation with the inner face of the walls 46 and 47, and upon complete wall straightening, the beams 18 advantageously permanently rest in flush and abutting contact with the walls.

Thereafter, the basement space 48 may be finished through installation of sheetrock or drywall paneling directly to the undersurfaces of the joists 54 and to the inner surfaces of the beams 18. Upon such sheetrock installation, no obtrusions from the instant inventive assembly exist along the perpendicular wall 47, the upper jacking assemblies 2 installed there along being upwardly recessed, and the sheetrock typically being thicker than the plate thickness of the "U" bracket 22.

In order to minimize basement ceiling protrusions at the site of the jacking assemblies 2 installed along the parallel wall 46, the screw shafts 12 may, upon completion of wall straightening, be advantageously severed at the inner ends of sleeves 10.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. An assembly for straightening a basement's wall, the basement having a floor and being covered by a ceiling which comprises a plurality of joists, the joists being spaced from each other on center distances to define a plurality of interstitial cavities and being arranged with respect to the basement's wall in a configuration selected from the group consisting of perpendicular arrays and parallel arrays, the assembly for straightening the basement's wall comprising:

(a) an oblongated mounting plate having a length at least as great as the on center distance;

(b) joist mounting means adapted for fixedly attaching the oblongated mounting plate to at least a first joist among the plurality of joists, the joist mounting means being further adapted for both positioning the oblongated mounting plate within one of the interstitial cavities and bridging the oblongated mounting plate completely across at least two of the interstitial cavities; the joist mounting means, upon the perpendicular array selection, positioning the oblongated mounting plate within one of the interstitial cavities, and the joist mounting means, upon the parallel array selection, bridging the oblongated mounting plate completely across at least two of the interstitial cavities;

(c) a rigid beam having upper and lower ends;

(d) a jack screw assembly connected operatively to the oblongated mounting plate, the jack screw assembly being adapted for driving the rigid beam's upper end toward the basement's wall; and (e) anchor means connected operatively to the rigid beam's lower end, the anchor means being adapted for, upon the driving of the rigid beam's upper end toward the basement's wall, resisting movement of the rigid beam's lower end away from the basement's wall.

2. The assembly for straightening a basement's wall of claim 1 wherein the on center distance is substantially equal to 16".

3. The assembly for straightening a basement's wall of claim 2 wherein the joist mounting means comprises a plurality of apertures extending through the oblongated mounting plate.

4. The assembly for straightening a basement's wall of claim 3 wherein the oblongated mounting plate's apertures are arranged there along at intervals substantially equal to 16".

5. The assembly for straightening a basement's wall of claim 4 wherein the joist mounting means further comprises fasteners selected from the group consisting of bolts, wood screws, nails, and rivets, each selected fastener extending through one of the oblongated mounting plate's apertures.

6. The assembly for straightening a basement's wall of claim 1 wherein the rigid beam has a vertical dimension, and wherein, upon the perpendicular joist array selection, said vertical dimension extends the rigid beam from the basement's floor into one of the array's interstitial cavities.

7. The assembly for straightening a basement's wall of claim 6 wherein the jack screw assembly comprises an arm having proximal and distal ends, the arm's proximal end being fixedly attached to the oblongated mounting plate.

8. The assembly for straightening a basement's wall of claim 7 wherein the jack screw assembly comprises an internally helically threaded sleeve fixedly attached to the arm's distal end and further comprises an externally helically threaded shaft, the externally helically threaded shaft being received within the internally helically threaded sleeve.

9. The assembly for straightening a basement's wall of claim 8 wherein the externally helically threaded shaft has a longitudinal axis, wherein the rigid beam has a lateral width, and wherein the arm is fitted for displacing the shaft's longitudinal axis from the oblongated mounting plate a distance at least as great as one-half of the rigid beam's lateral width.

10. The assembly for straightening a basement's wall of claim 9 wherein the externally helically threaded shaft has outer and inner ends, and further comprising a beam capturing bracket connected operatively to said shaft's outer end.

11. The assembly for straightening a basement's wall of claim 10 further comprising turning means connected operatively to the externally helically threaded shaft's inner end.

12. The assembly for straightening a basement's wall of claim 1 wherein the anchor means is further adapted for pulling the rigid beam's lower end toward the basement's wall.

13. The assembly for straightening a basement's wall of claim 12 wherein the anchor means is attached to the basement's wall.

14. The assembly for straightening a basement's wall of claim 13 wherein the anchor means comprises a pulling screw assembly.

15. The assembly for straightening a basement's wall of claim 14 wherein the pulling screw assembly comprises left and right helically threaded posts.

16. The assembly for straightening a basement's wall of claim 15 wherein the pulling screw assembly further comprises a beam catching "U" bracket, the beam catching "U" bracket being connected operatively to left and right helically threaded posts.

* * * * *